US009826816B1

(12) United States Patent
Chang

(10) Patent No.: US 9,826,816 B1
(45) Date of Patent: Nov. 28, 2017

(54) MODULAR WEARABLE OBJECT

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 0 days.

(21) Appl. No.: 15/485,508

(22) Filed: Apr. 12, 2017

(30) Foreign Application Priority Data

Dec. 16, 2016 (TW) ..... 105141832 A

(51) Int. Cl.

| | |
|---|---|
| ***A45F 3/08*** | (2006.01) |
| ***A41D 1/04*** | (2006.01) |
| ***A45F 3/04*** | (2006.01) |
| ***A45F 3/12*** | (2006.01) |
| ***F41H 1/02*** | (2006.01) |

(52) U.S. Cl.
CPC ..... *A45F 3/08* (2013.01); *A41D 1/04* (2013.01); *A45F 3/047* (2013.01); *A45F 3/12* (2013.01); *F41H 1/02* (2013.01)

(58) Field of Classification Search
CPC ... A45F 3/08; A45F 3/047; A45F 3/12; A41D 1/02; A41D 1/04
USPC ..... 224/153, 580–583
See application file for complete search history.

(56) References Cited

U.S. PATENT DOCUMENTS 5,927,575 A * 7/1999 Gatling ..... A01M 31/02 224/153
8,505,791 B2 * 8/2013 Fidrych ..... A45F 3/047 224/197
2001/0025867 A1 * 10/2001 Chuang ..... A45F 3/04 224/627
2007/0228091 A1 * 10/2007 Shawen ..... A45C 15/00 224/153
2009/0127299 A1 * 5/2009 Jamlang ..... A45F 4/02 224/153
2010/0006610 A1 * 1/2010 Stinnett ..... A45F 3/08 224/153
2011/0024474 A1 * 2/2011 Di Stasio ..... A45F 3/047 224/645
2015/0144666 A1 * 5/2015 Rana ..... A45F 3/04 224/153
2016/0081460 A1 * 3/2016 Di Stasio ..... A45F 3/047 224/153

* cited by examiner

*Primary Examiner* — Corey Skurdal
(74) *Attorney, Agent, or Firm* — Lynette Wylie; Apex Juris, pllc.

(57) ABSTRACT

A modular wearable object includes a main body, two combination plates, and a carrier. The main body includes a main portion and at least one extension portion. The extension portion extends outward from an end of the main portion. A part of each of the combination plates is fixed on the extension portion. Each of the combination plates has a first connecting portion located on a surface thereof facing the main body. The carrier includes a bearing portion and a positioning portion, wherein a space is formed therebetween to be passed through by the main portion. The positioning portion has a second connecting portion located on a surface thereof opposite to the main portion. The second connecting portion is adapted to be detachably engaged with each of the first connecting portions. A relative position between the main body and the carrier can be adjusted, and the carrier is replaceable.

8 Claims, 11 Drawing Sheets

MODULAR WEARABLE OBJECT

BACKGROUND OF THE INVENTION

1. Technical Field

The present invention relates generally to a wearable structure for carrying objects, and more particularly to a modular wearable object.

2. Description of Related Art

A wide variety of wearable objects like backpacks or vests with pockets is commonly used, as items can be easily received in such a wearable object to be carried around. However, since the load is mainly borne by the user's shoulders alone, carrying heavy items for a long period may cause muscle strains at neck or shoulders or even worse injuries. In addition, though wearable objects usually have different sizes for selection, it would be impossible to satisfy all users of different body sizes and different genders. Putting on an unfit wearable object may lead to an uncomfortable use experience.

Furthermore, a typical and conventional wearable object such as a backpack is confined by its capacity. In other words, a wearable object with large capacity would be required for large or more items, and, on the contrary, a wearable object with small capacity would be rather suitable for small or fewer items to prevent the items from moving or colliding against each other. Therefore, a user may need wearable objects of different sizes for different usage scenarios, which unnecessarily increases additional expenses and inconvenience for storage. In addition, among the wearable objects owned by one user, some wearable objects of certain sizes may be less comfortable to use.

Therefore, a wearable object capable of satisfying users of all kinds of body sizes, improving the comfort in use, and allowing various types of items to be received therein would be welcomed by consumers.

BRIEF SUMMARY OF THE INVENTION

In view of the above, the primary objective of the present invention is to provide a modular wearable object. By changing an assembly position, the modular wearable object could improve the comfort in use. Furthermore, the carrier of the modular wearable object could be replaced to meet specific requirements for receiving different kinds of items.

The present invention provides a modular wearable object, including a main body, two combination plates, and a carrier. The main body includes a main portion and at least one extension portion, wherein the at least one extension portion extends outward from an end of the main portion. A part of each of the combination plates is respectively engaged with the at least one extension portion, and each of the combination plates has a first connecting portion located on a surface thereof facing the main body. The carrier includes a bearing portion and a positioning portion, wherein two ends of the positioning portion are connected to the bearing portion to form a space between the bearing portion and the positioning portion. The space is adapted to be passed through by the main portion. The positioning portion has a second connecting portion located on a surface thereof opposite to the main portion, wherein the second connecting portion is adapted to be detachably engaged with each of the first connecting portions, whereby to locate the positioning portion between each of the combination plates and the bearing portion.

With the aforementioned design, the main body is detachably engaged with the carrier through the combination plates. The relative position of the main body and the carrier could be adjusted to improve the comfort in use. Furthermore, the carrier could be replaced to meet practical requirements for receiving items of different sizes.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
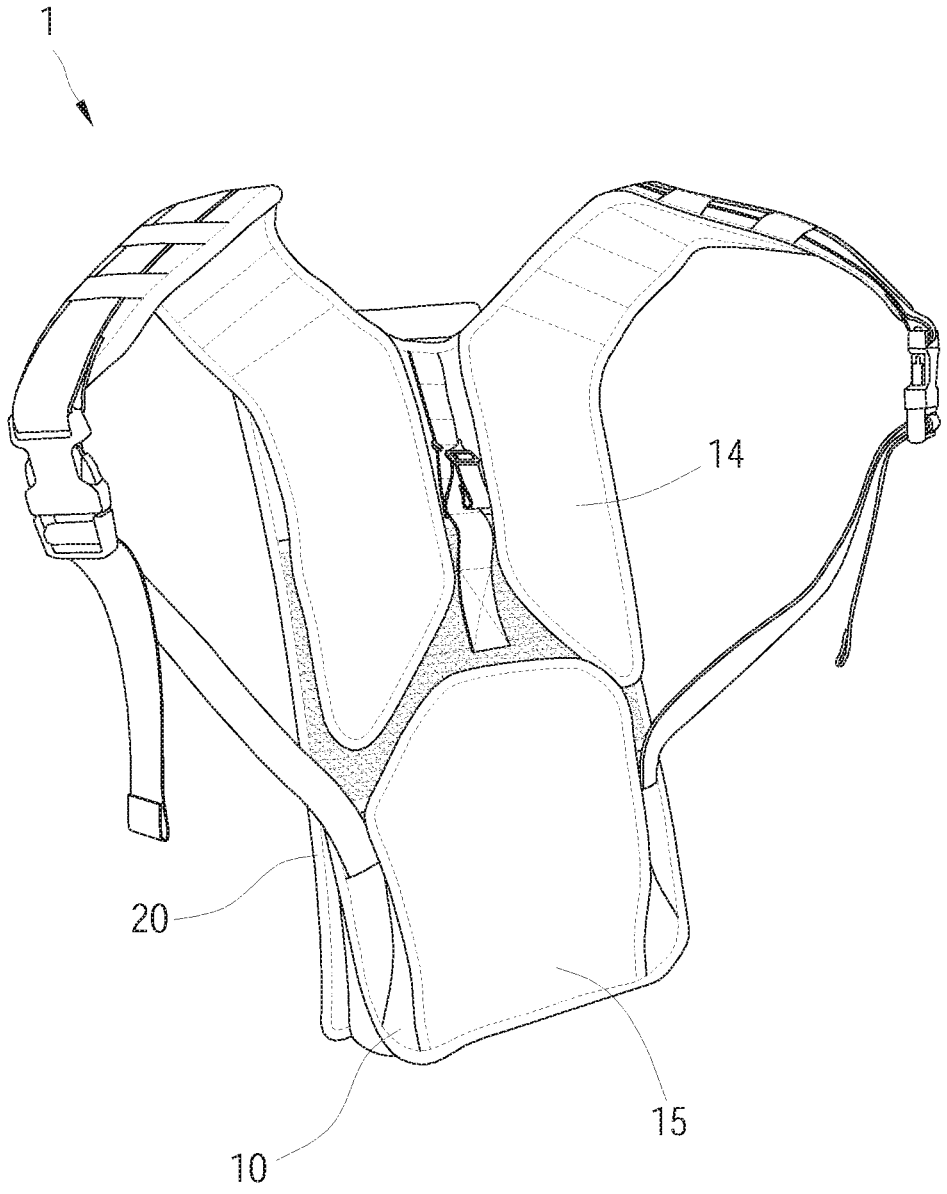
FIG. 1 is a perspective view of the modular wearable object of a first embodiment of the present invention.
Figure 2:
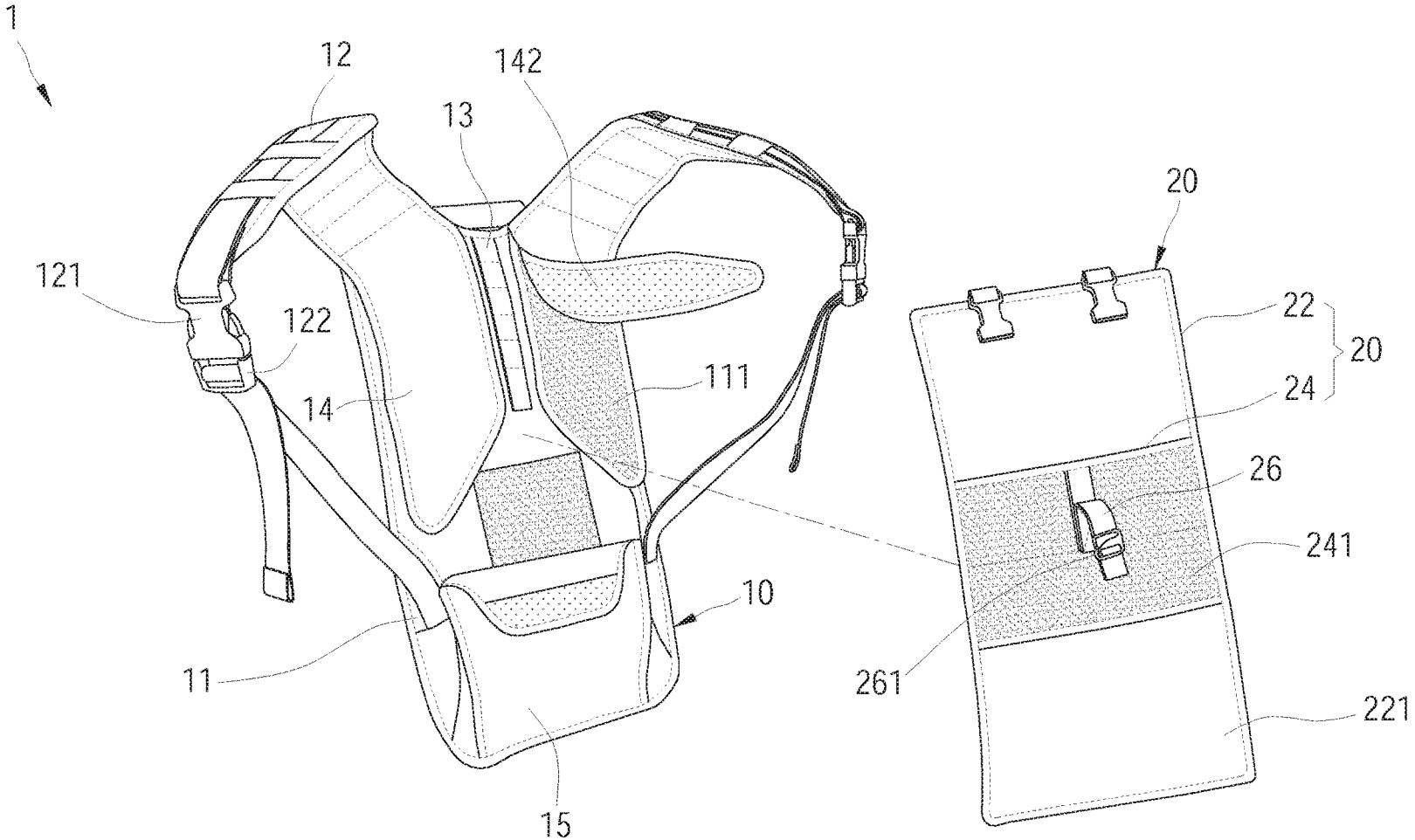
FIG. 2 is an exploded view of the modular wearable object shown in FIG. 1.

A modular wearable object 1 of a first embodiment of the present invention is illustrated in FIG. 1 and FIG. 2, which is composed of a main body 10, two combination plates 14, a cushion 15, and a carrier 20.

In the first embodiment, the main body 10 includes a main portion 11, two extension portions 12, and a first connecting member 13. Each of the extension portions 12 is a strap as an example, and is flexible, wherein an end of each of the extension portions 12 extends outward from a top edge of the main portion 11, while another end thereof is provided with a first connector 121 thereon. When the wearable object 1 is in use, the extension portions 12 surround user's shoulders. Two second connectors 122 are fixed on the main portion 11 and are adapted to engage with the first connectors 121, respectively. The second connectors 122 are conventional structures for adjusting a length of the strap. Thus we are not going to describe it in details herein.

In the first embodiment, the first connecting member 13 is a band sewed on the main portion 11. More specifically, the first connecting member 13 is sewed in a way that a plurality of rings are formed between the first connecting member 13 and the main portion 11 in a vertical direction.

Each of the combination plates 14 and the cushion 15 are made of supportive pads which have a certain thickness, wherein the combination plates 14 and the cushion 15 are adapted to absorb a force borne by the user, which would reduce pressure on the portion under the force. When the wearable object 1 is in use, the combination plates 14 would abut against the shoulders and back of the user, wherein a part of each of the combination plates 14 is sewed on one of the extension portions 12. Each of the combination plates 14 has a first connecting portion 142 located on a surface thereof facing the main body 10. In the first embodiment, the first connecting portions 142 are hook-and-loop fasteners. In addition, two fastening areas 111 are provided on the main portion 11 of the main body 10, wherein each of the fastening areas 111 is adapted to be detachably engaged with one of the first connecting portions 142. When the main body 10 is not in use, each of the combination plates 14 could be fixed on one of the fastening areas 111 of the main portion 11 through the corresponding first connecting portion 142.

In the first embodiment, the cushion 15 is sewed on the main portion 11 of the main body 10, and would abut against the waist of the user to prevent leaving a hollow space between the waist and the wearable object 1 while the wearable object 1 is in use; most of the weight of the wearable object 1 would fall on the shoulders of the user due to such a hollow space. In addition, a pocket is further formed between the cushion 15 and the main portion 11, which is adapted to receive objects therein. For instance, a protective ballistic plate (not shown) could be put into the pocket. Said pocket could be opened and closed through a detaching structure, which is a hook-and-loop fastener as an example, provided at an opening of said pocket between the cushion 15 and the main portion 11. However, the detaching structure is not limited to be a hook-and-loop fastener exemplified above, but could also be a zipper or pairs of buttons in other embodiments. Also, said pocket formed between the cushion and the main body is not an essential component of the modular wearable object 1 of the present invention, and could be omitted in other embodiments.

Figure 3:
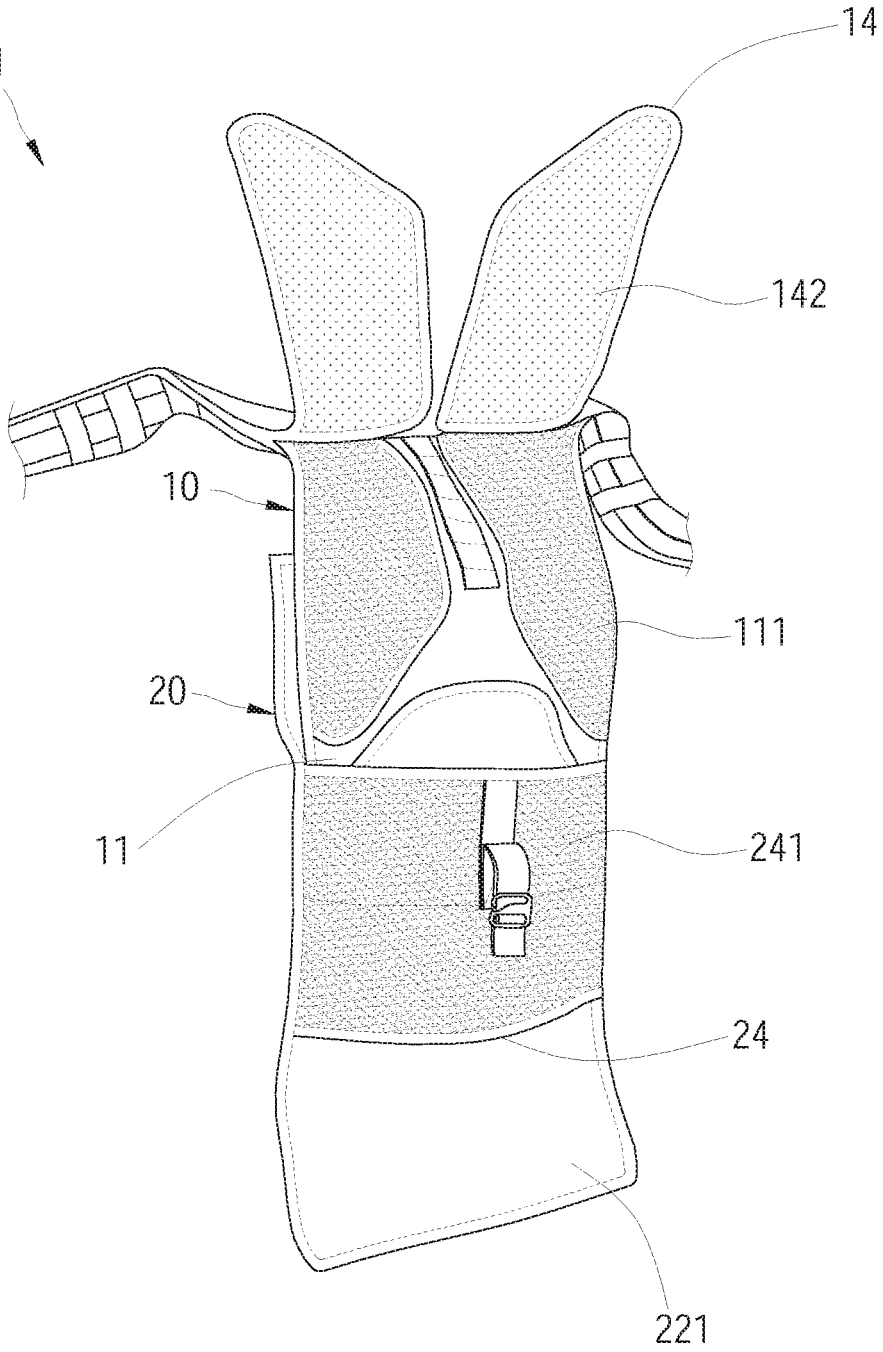
FIG. 3 is a schematic diagram, showing the main portion enters the space formed between the bearing portion and the positioning portion.
Figure 4:
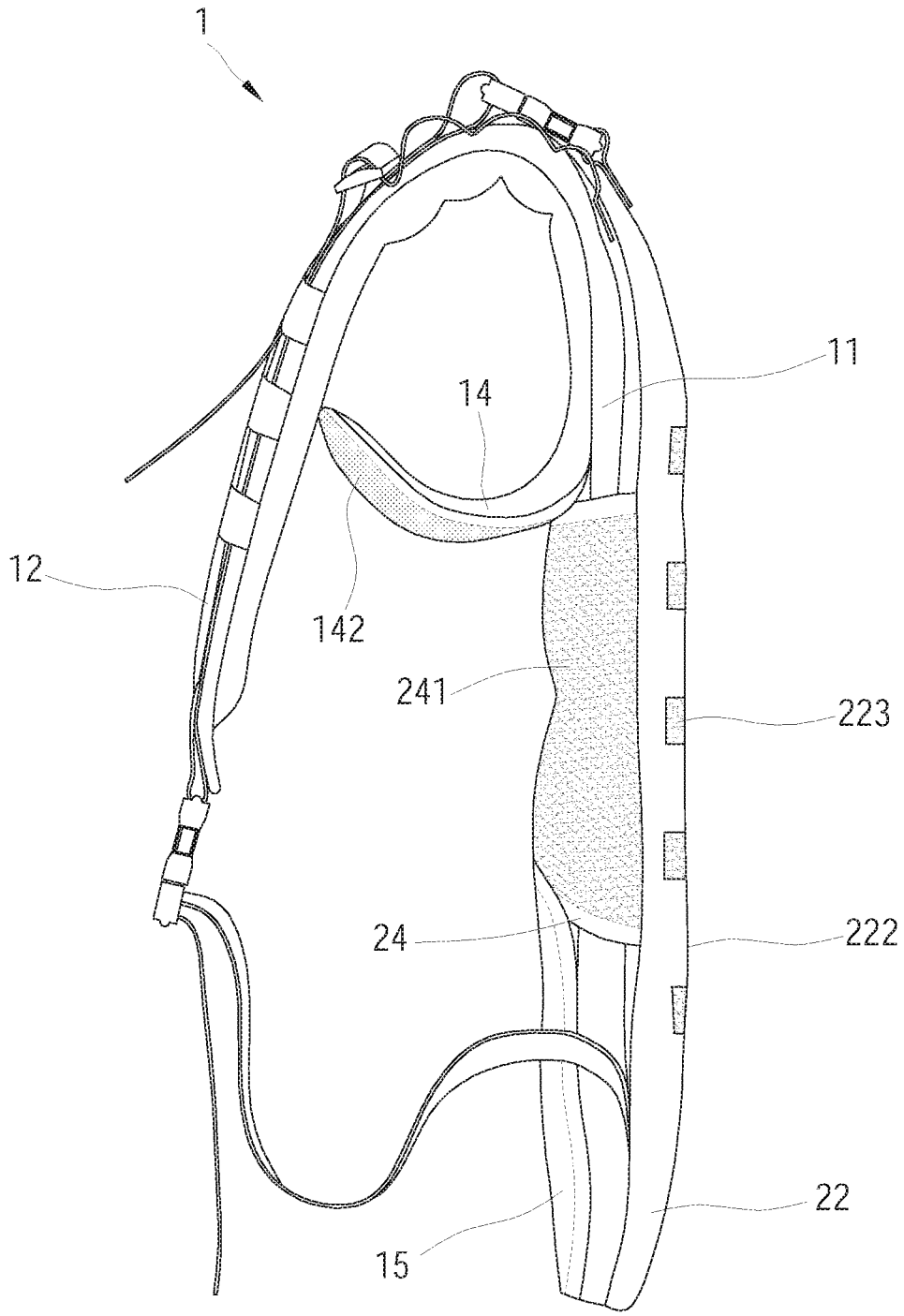
FIG. 4 is a side view, showing the second connecting portion of the positioning portion is adapted to be detachably engaged by the first connecting portion.

As shown in FIG. 3 and FIG. 4, the carrier 20 includes a bearing portion 22, a positioning portion 24, and a second connecting member 26, wherein a length of the second connecting member 26 could be adjusted. The bearing portion 22 has a first surface 221 and a second surface 222, wherein the first surface 221 is opposite to the second surface 222. When the wearable object 1 is in use, the first surface 221 is closer to the user than the second surface 222 is. The second surface 222 has a plurality of hook-and-loop fasteners 223 provided thereon.

Two ends of the positioning portion 24 are connected to the first surface 221 of the bearing portion 22, respectively, so that a space is formed between the ends of the positioning portion 24 and the bearing portion 22, wherein said space is adapted to be passed through by the main portion 11 of the main body 10. The positioning portion 24 has a second connecting portion 241 located on a surface of the positioning portion 24 opposite to the main portion 11, wherein the positioning portion 24 is adapted to be detachably engaged with the first connecting portions 142 of the combination plates 14. In the first embodiment, the second connecting portion 241 is a hook-and-loop fastener. In other embodiments, the first connecting portion and the second connecting portion are not limited to be hook-and-loop fasteners as exemplified above, but could be a pair of male and female connectors or other engaging components. With the aforementioned design of the wearable object 1, a depth of the main portion 11 entering the carrier 20 could be adjusted to change a relative position of the main body 10 and the carrier 20 before the main body 10 and the carrier 20 are getting engaged with each other through the combination plates 14 and the positioning portion 24. In this way, the wearable object 1 could be adjusted to fit the body size of the user, whereby each of the combination plates 14 and the cushion 15 could abut against proper positions on the user's body.

An end of the second connecting member 26 is fixed on the positioning portion 24, while another end thereof has a hook 261 provided thereon. According to a position of the main body 10, the user could optionally hook the hook 261 onto one of the rings formed between the first connecting member 13 and the main portion 11, which could enhance the engaging strength between the main body 10 and the carrier 20. In other embodiments, the first connecting member and the second connecting member could be other equivalent types or have other equivalent structures, not limited by the aforementioned design.

Figure 5:
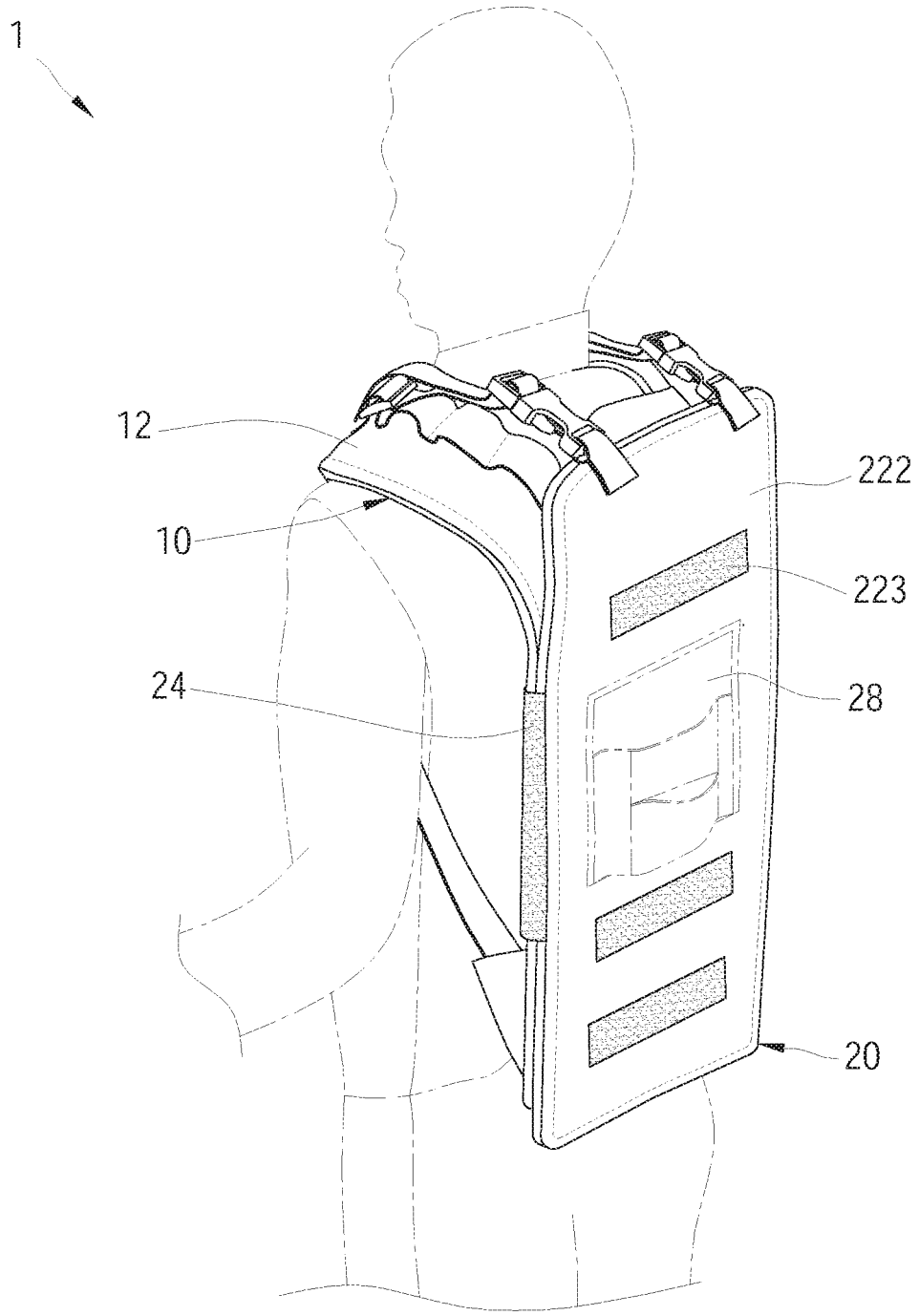
FIG. 5 is a schematic diagram of the first embodiment of the present invention, showing the carrier is adapted to carry the secondary carrier.

As shown in FIG. 5, the purpose of providing the hook-and-loop fasteners 223 on the second surface 222 of the bearing portion 22 is to allow a secondary carrier 28 to be detachably engaged thereon. More specifically, said secondary carrier 28 has a hook-and-loop fastener adapted to engage with the hook-and-loop fasteners 223. With such design, the secondary carrier 28 could be replaced to receive different types of objects according to specific requirements or environments. In the first embodiment, the secondary carrier 28 is a toolkit pack as an example. In other embodiments, the secondary carrier 28 could be a bag of other types. Furthermore, depending on the sizes of secondary carriers, there could be more than one secondary carrier engaged on the bearing portion at once. In other embodiments, various means could be used to engage the carrier 20 with the secondary carrier 28, including using buttons, strings, a zipper, etc. In other words, as long as it could provide an equivalent effect, any engaging means should be included within the scope of the present invention.

Figure 6:
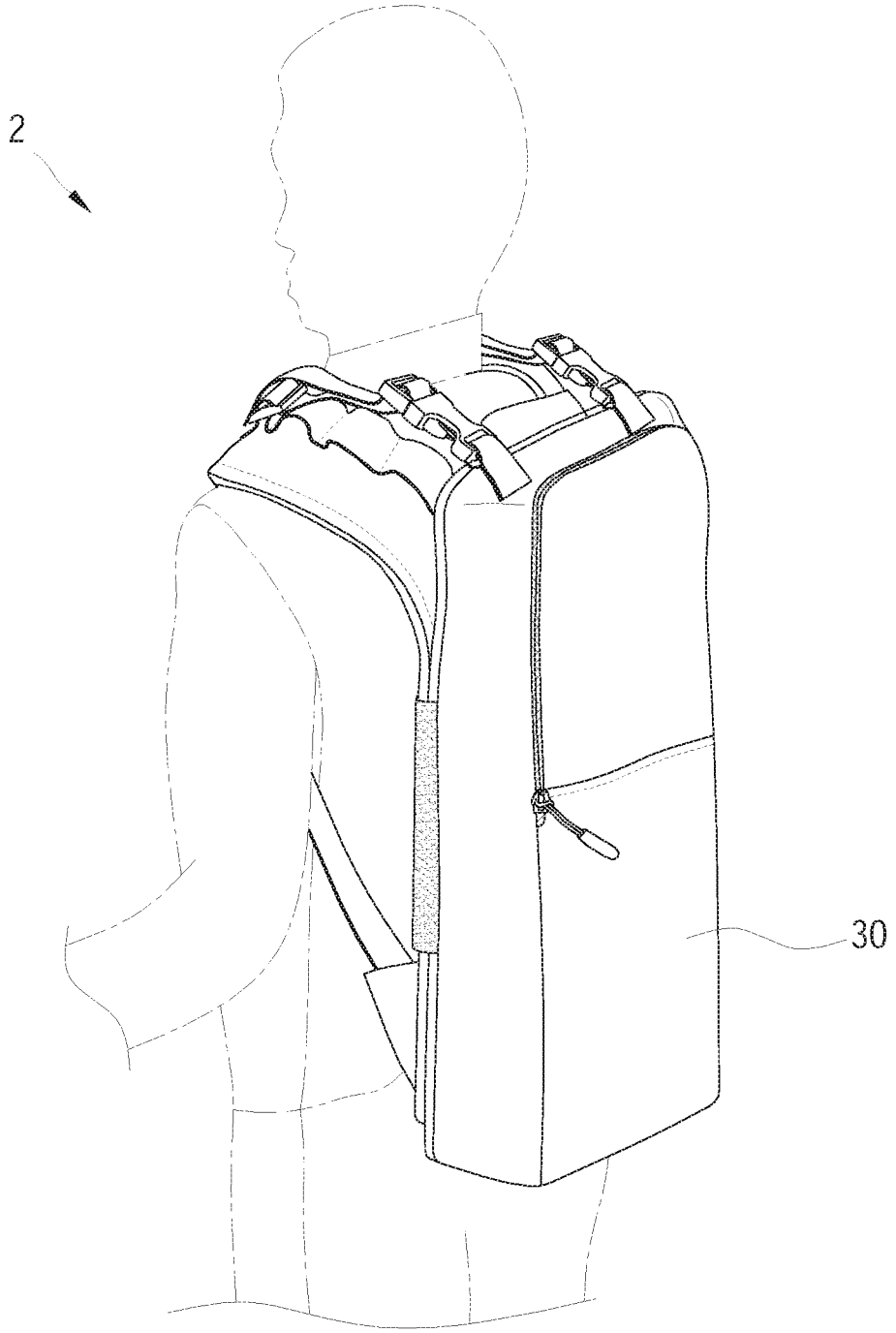
FIG. 6 is a perspective view of the modular wearable object of a second embodiment of the present invention.

In addition to being detachably engaged by the secondary carrier as disclosed in the first embodiment, a carrier itself could also be replaceable. A modular wearable object 2 of a second embodiment of the present invention illustrated in FIG. 6 includes a carrier 30, which is a big rectangular bag, and could be replaced by another carrier to receive different types of objects as required.

Furthermore, since a distance between the shoulders and the waist would be different for users of different heights, two more embodiments are provided below to meet the requirements of various body types.

Figure 7:
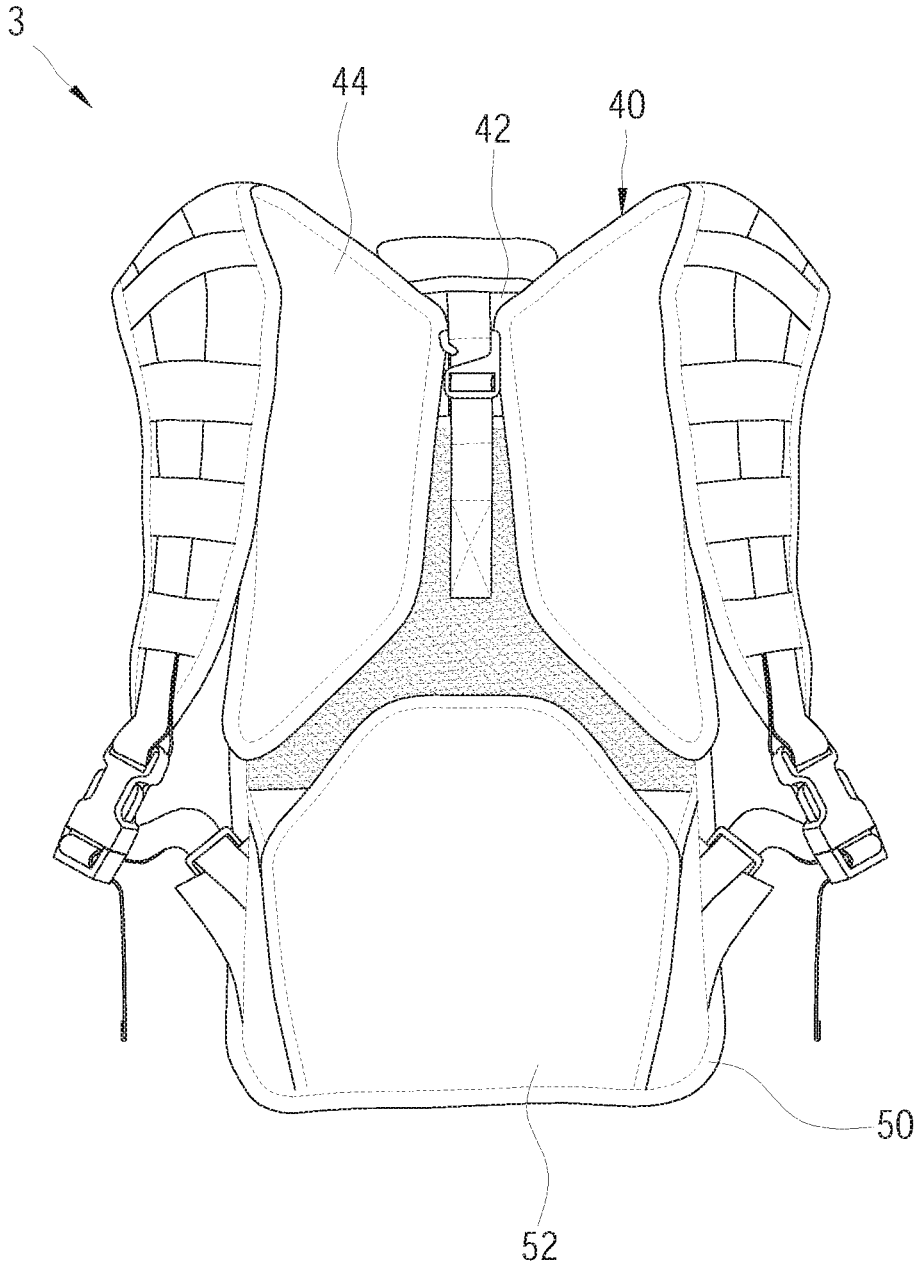
FIG. 7 is a perspective view of the modular wearable object of a third embodiment of the present invention.
Figure 8:
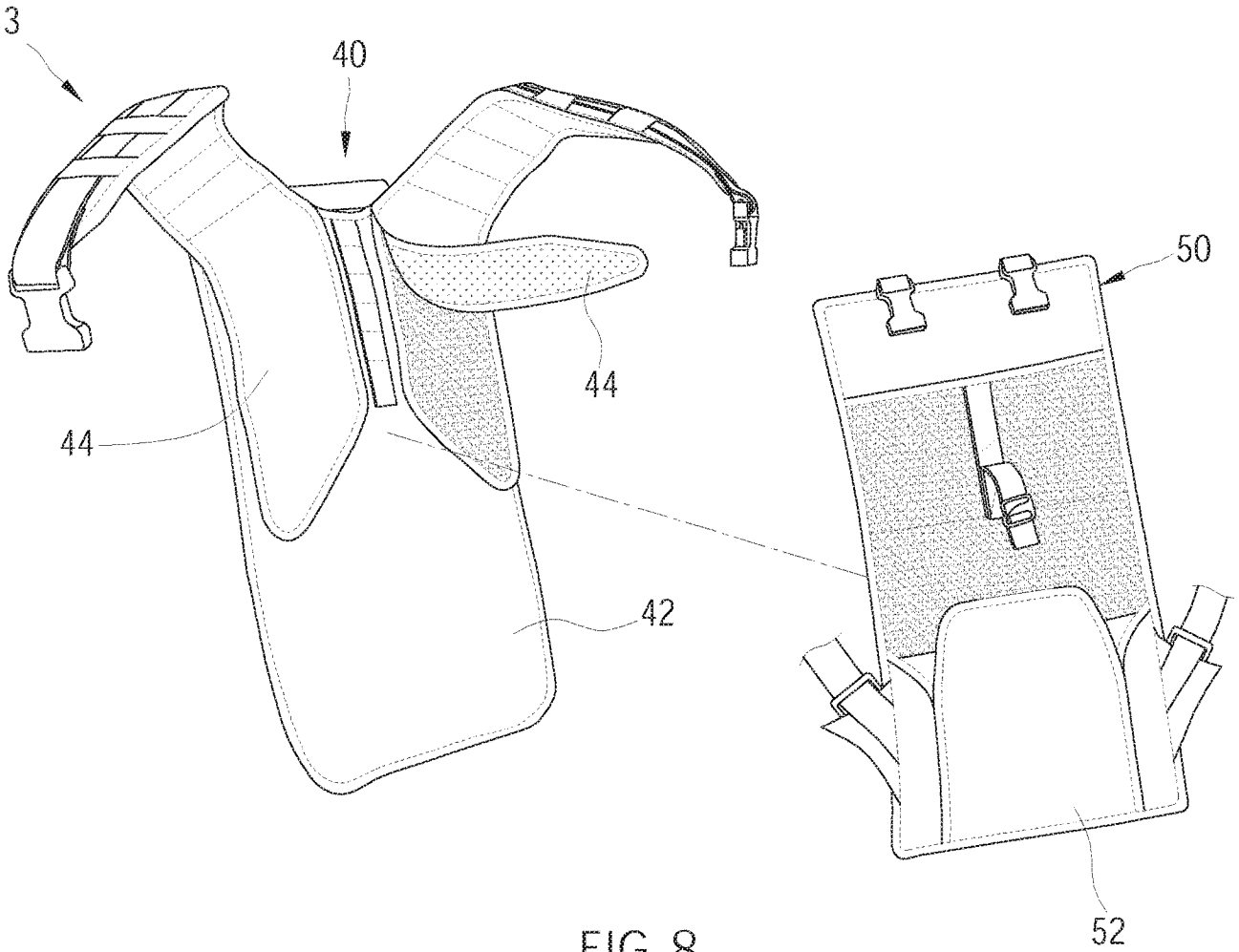
FIG. 8 is an exploded view of the modular wearable object shown in FIG. 7.

A modular wearable object 3 of a third embodiment of the present invention is illustrated in FIG. 7 and FIG. 8, which is composed of a main body 40 and a carrier 50, which are detachable from each other. The difference between the modular wearable object 3 of the third embodiment and that of the first embodiment is that, the cushion 15 of the first embodiment is engaged with the main body 10, while a cushion 52 of the third embodiment is engaged with the carrier 50. When the wearable object 3 is in use, the user could adjust a length of a main portion 42 of the main body 40 which enters the carrier 50 according to a distance between the shoulders and the waist of the user, whereby to change a distance between each combination plate 44 and the cushion 52. In this way, for users of different heights, the combination plates 44 and the cushion 52 of the third embodiment could be ensured to properly abut against the rear of the shoulders and the waist thereof, respectively.

Figure 9:
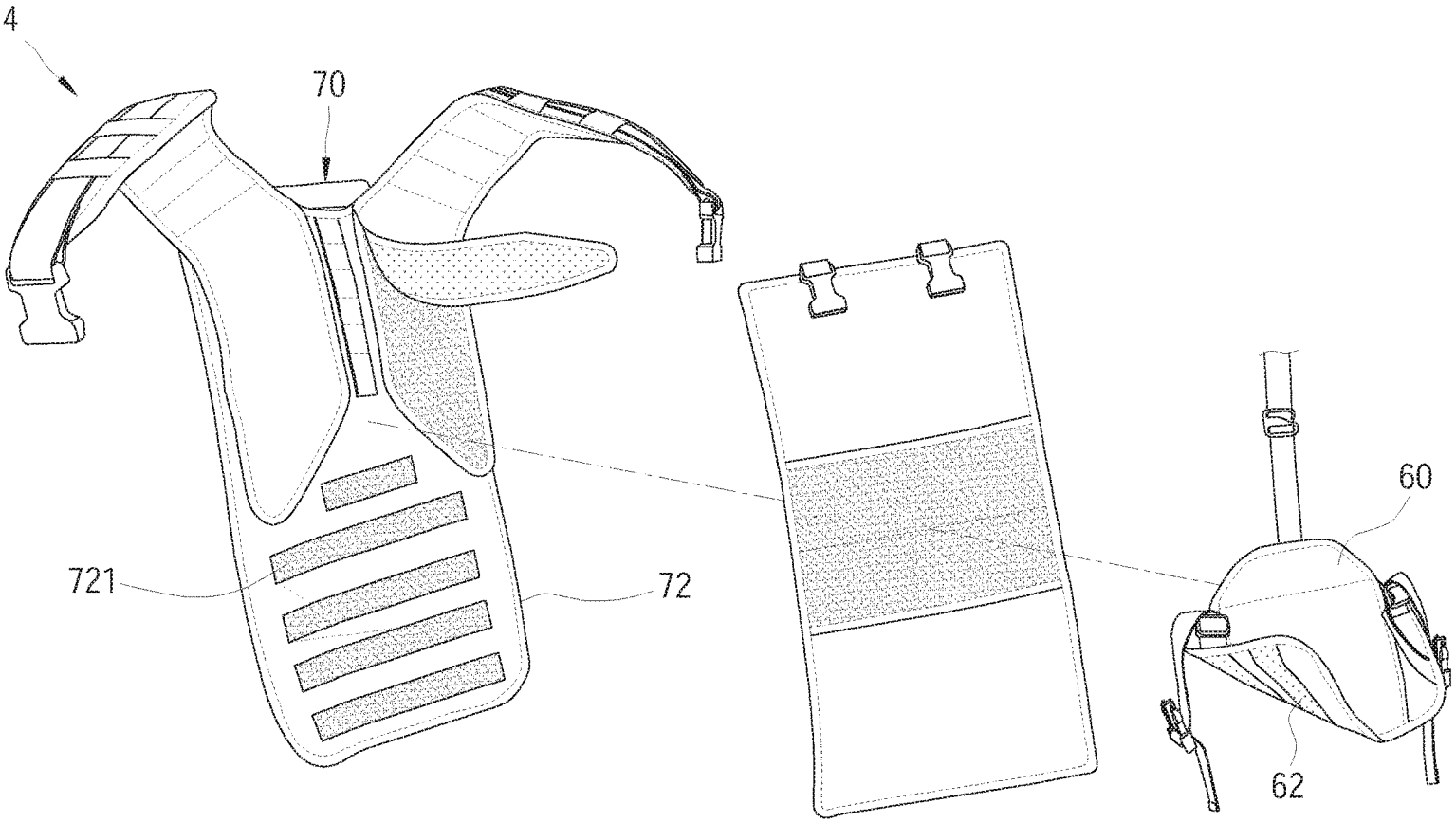
FIG. 9 is an exploded view of the modular wearable object of a fourth embodiment of the present invention.
Figure 10:
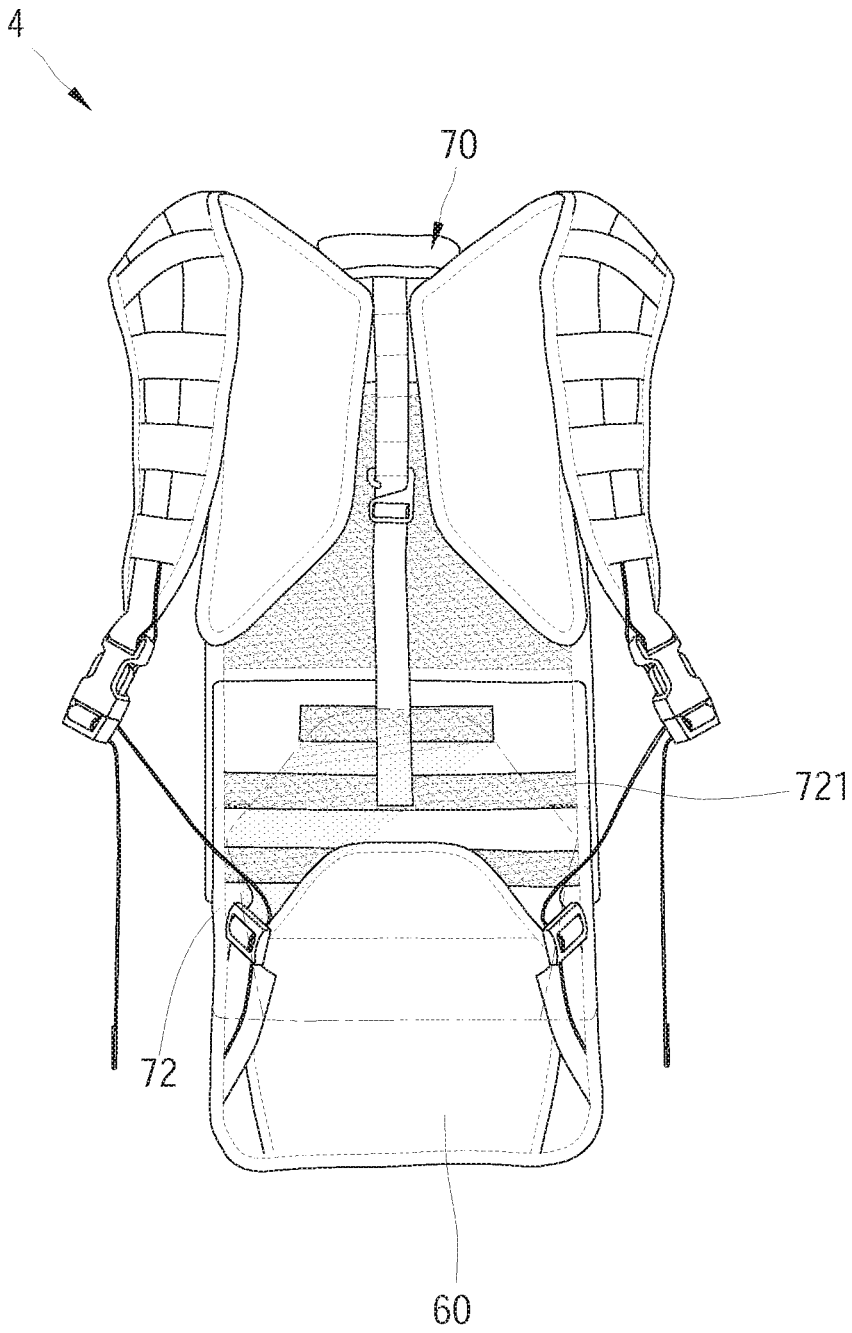
FIG. 10 is a perspective view of the modular wearable object shown in FIG. 9.

A modular wearable object 4 of a fourth embodiment of the present invention is illustrated in FIG. 9 and FIG. 10. A cushion 60 of the fourth embodiment has a third connecting portion 62, and a main portion 72 of a main body 70 has a fourth connecting portion 721, which is adapted to be detachably engaged with the third connecting portion 62. With such design, a position of the cushion 60 where it is engaged on the fourth connecting portion 721 could be adjusted, whereby a distance between the cushion 60 and each combination plate 74 could be adjusted according to a distance between the shoulders and the waist of the user. Therefore, requirements for users of different heights could be all satisfied.

The structures of the modular wearable object of each of the abovementioned embodiments could enlarge the portion of the user body which bears the load while in use, and could improve the comfort for users of various body types. Furthermore, the carrier or the secondary carrier could be replaced according to the types of items to be received therein.

Figure 11:
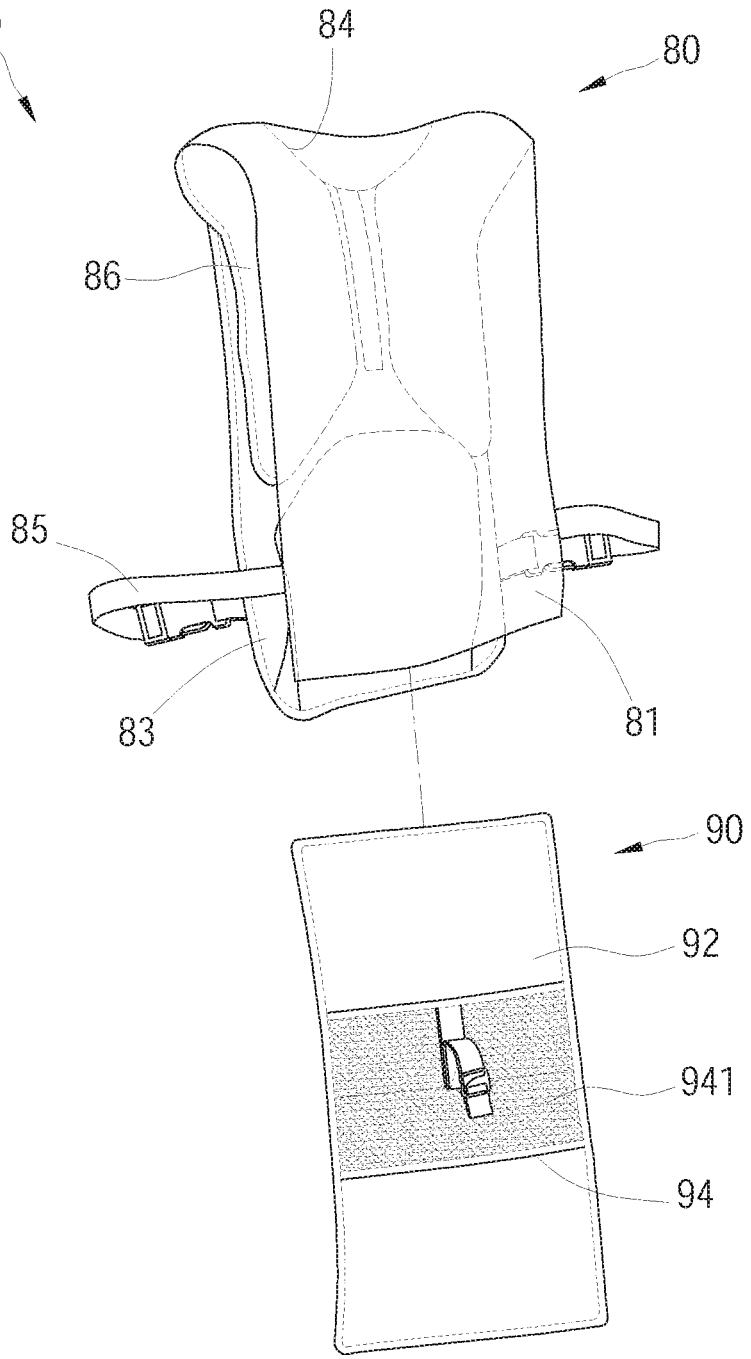
FIG. 11 is a perspective exploded view of the modular wearable object of a fifth embodiment of the present invention.

In practice, the modular wearable object could be a vest, such as a modular wearable object 5 of a fifth embodiment of the present invention illustrated in FIG. 11.

The wearable object 5 is composed of a main body 80, two combination plates 86, and a carrier 90. The main body 80 includes an extension portion 81 and a main portion 83, wherein the extension portion 81 extends outward from an end of the main portion 83. In the fifth embodiment, the extension portion 81 is a rear cloth of a garment, which is adapted to cover the back of the user when the wearable object 5 is in use. The main portion 83 is a front cloth of the garment, which is adapted to cover a portion of the shoulders which surrounds the neck, and to cover a body portion from a chest to a belly when the wearable object 5 is in use. An opening 84 is formed between the extension portion 81 and the main portion 82 to be passed through by the neck of the user.

It is worth mentioning that, both the main portion 83 and the extension portion 82 has a ballistic plate (not shown) provided therein, which is adapted to enhance the protective ability of the wearable object 5. The main portion 83 or the extension portion 82 could be optionally provided to cover the chest and the belly of the user when the wearable object 5 is in use. In addition, the main body 80 includes two adjusting belts 85, wherein a length of the adjusting belts 85 could be adjusted, and two ends of each of the adjusting belts 85 are respectively engaged with a peripheral edge of the main portion 83 and a peripheral edge of the extension portion 82. In this way, users could adjust a distance between the main portion 83 and the extension portion 82 according to their body types, whereby to make the main body 80 properly abut against an upper body of the user.

A part of each of the combination plates 86 is fixed on the extension portion 81, respectively. Each of the combination plates 86 has a first connecting portion (not shown). The carrier 90 has a bearing portion 92 and a positioning portion 94, wherein two ends of the positioning portion 94 are respectively connected to the bearing portion 92. In the fifth embodiment, a ballistic plate (not shown) is provided in the bearing portion 92. A space is formed between the positioning portion 94 and the bearing portion 92, wherein the space is adapted to be passed through by the main portion 83. The positioning portion 94 has a second connecting portion 941 located on a surface of the positioning portion 94 opposite to the main portion 83, and is adapted to be detachably engaged by each of the first connecting portions, whereby to make the positioning portion 94 located between each of the combination plates 86 and the bearing portion 92.

The wearable object 5 of the fifth embodiment is a bulletproof vest, which could provide a defensive and protective function. If required, the ballistic plate could be taken out from the main body 80 or the carrier 90 to reduce a weight of the wearable object 5. Alternatively, the ballistic plate could be put back in to enhance a defensive effect. Also, the body portion covered by the carrier 90 and the main body 8 could be adjusted by changing the relative engaging position between the combination plates 86 and the carrier 90, so as to meet different defensive requirements for users of all kinds of body shapes.

It must be pointed out that the embodiments described above are only some preferred embodiments of the present invention. All equivalent structures which employ the concepts disclosed in this specification and the appended claims should fall within the scope of the present invention.

What is claimed is:

1. A modular wearable object, comprising:

a main body, which comprises a main portion and at least one extension portion, wherein the at least one extension portion extends outward from an end of the main portion;

two combination plates, wherein a part of each of the combination plates is respectively engaged with the at least one extension portion, and each of the combination plates has a first connecting portion located on a surface thereof facing the main body; and a carrier comprising a bearing portion and a positioning portion, wherein two ends of the positioning portion are connected to the bearing portion to form a space between the bearing portion and the positioning portion, wherein the space is adapted to be passed through by the main portion; the positioning portion has a second connecting portion located on a surface thereof opposite to the main portion, wherein the second connecting portion is adapted to be detachably engaged with each of the first connecting portions, whereby to locate the positioning portion between each of the combination plates and the bearing portion.

2. The modular wearable object of claim 1, wherein the main body comprises a first connecting member provided on the main portion, and the carrier comprises a second connecting member, which is detachably engaged with the first connecting member; a length of at least one of the first connecting member and the second connecting member is adjustable.

3. The modular wearable object of claim 2, wherein a plurality of rings are formed and vertically arranged between the first connecting member and the main portion; the second connecting member is detachably engaged with one of the rings.

4. The modular wearable object of claim 1, further comprising a cushion, which is engaged with either the main portion or the bearing portion; when the modular wearable object is in use, the cushion abuts against a waist or a belly of a user.

5. The modular wearable object of claim 4, wherein a pocket is formed between the cushion and either the main portion or the bearing portion; the pocket is adapted to receive objects.

6. The modular wearable object of claim 1, further comprising a cushion, wherein the cushion has a third connecting portion, and the main portion of the main body has a fourth connecting portion which is adapted to be detachably engaged by the third connecting portion, so as to adjust a distance between the cushion and the combination plates.

7. The modular wearable object of claim 1, further comprising a secondary carrier detachably engaged with the bearing portion of the carrier.

8. The modular wearable object of claim 1, wherein the main body has an opening located between the main portion and the extension portions; the opening is adapted to be passed through by a neck of a user.

* * * * *